United States Patent [19]

Chung

[11] Patent Number: 4,706,937

[45] Date of Patent: Nov. 17, 1987

[54] AUTOMOBILE COMPRESSOR-JACK DEVICE

[75] Inventor: Yo C. Chung, Chia I Hsien, Taiwan

[73] Assignee: Richard Lee, Taiwan

[21] Appl. No.: 884,100

[22] Filed: Jul. 10, 1986

[51] Int. Cl.[4] ..... B66F 3/24

[52] U.S. Cl. ..... 254/93 H; 254/1; 7/100

[58] Field of Search ..... 254/1, 93 H, 93 R, 89 H, 254/423; 7/100

[56] References Cited

U.S. PATENT DOCUMENTS 1,624,151 4/1927 Shevlin ..... 254/93 H 1,983,444 12/1934 Dry ..... 254/1

4,598,898 7/1986 Hsu et al. ..... 254/93 H

*Primary Examiner*—Frederick R. Schmidt

*Assistant Examiner*—Judy J. Hartman

*Attorney, Agent, or Firm*—Steinberg & Raskin

[57] ABSTRACT

An automatic compressor-jack device which comprises an air compressor, a hydraulic jack and a transmission mechanism. The transmission mechanism, which is driven by a motor through a reduction gear, comprises an eccentrically disposed pin to connect to the piston rods of the cylinders of the compressor and the jack. Therefore, when the motor rotates, the transmission mechanism drives the air compressor and jack at the same time. That is, this one device allows the user two tire repair functions.

7 Claims, 4 Drawing Figures

AUTOMOBILE COMPRESSOR-JACK DEVICE

BACKGROUND OF THE INVENTION

An air compressor and a hydraulic jack are two essential devices for repairing flat tires of automobiles. Conventional air compressors are driven by a motor, while hydraulic jacks are driven by a motor or hand-rod. However, it is inconvenient to carry two separate devices, compressor and jack, when fixing a flat tire. If one of these two devices is not in the automobile when it has a flat tire, the other has no use. For example, if the driver has an air compressor in his trunk, he still can not repair a flat tire without a jack. Therefore, it is the main object of the present invention to combine an air compressor and hydraulic jack together to make sure that the air compressor and hydraulic jack are always usable and workable.

SUMMARY OF THE INVENTION

It is the primary object of the present invention to provide an automobile compressor-jack device which combines an air compressor and a hydraulic jack together. Since the air compressor and hydraulic jack are driven by one motor, the two functions of air compressor and hydraulic jack are combined for repairing flat tires.

Further object and advantages of the present invention will become apparent as the following description proceeds, and the features of novelty which characterize the invention will be pointed out with particularity.

DETAILED DESCRIPTION OF THE INVENTION

Figure 3:
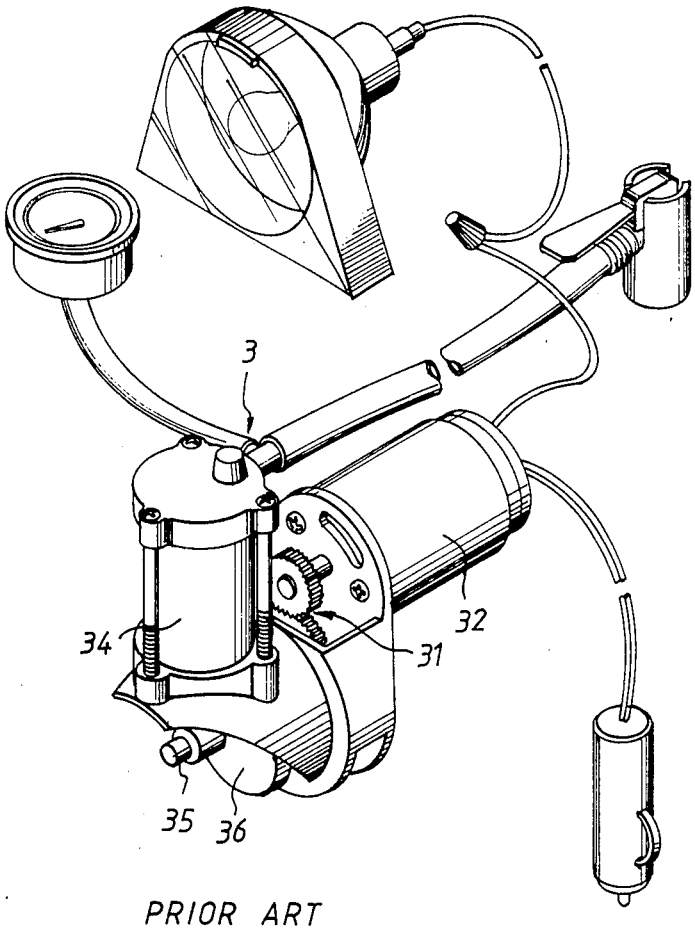
PRIOR ART FIG. 3
FIG. 3 is a perspective view of a conventional air compressor.
Figure 4:
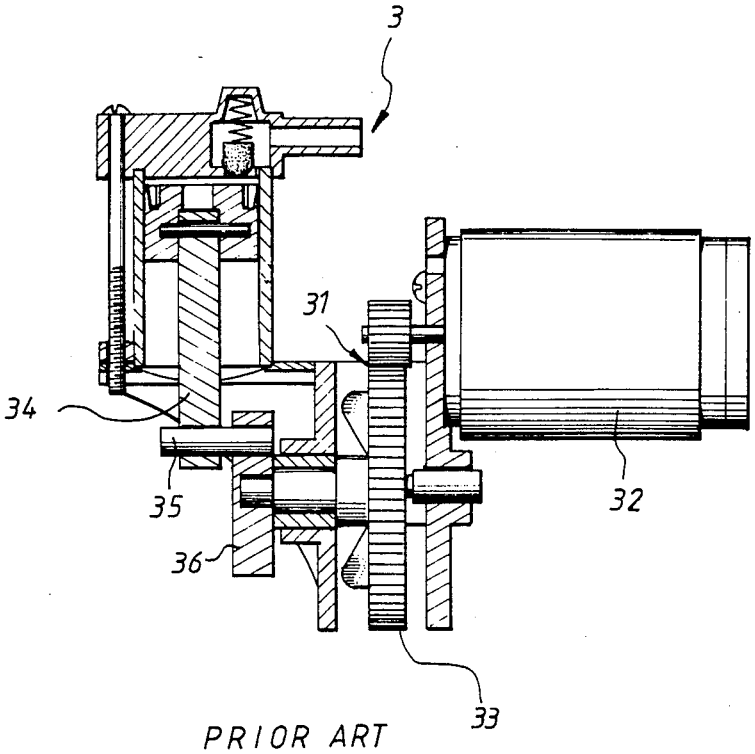
PRIOR ART FIG. 4
FIG. 4 is a partial cross-sectional view of a conventional air compressor showing the transmission mechanism connected to motor and piston rods of a compressor.

Referring to FIG. 3 and FIG. 4, it can be seen that conventional air compressors (3) comprise a transmission mechanism (31). The transmission mechanism (31) is connected to a motor (32) through its reduction gears (33) and with a piston rod (34) of air compressor (3) through its transmission pin (35). The transmission pin (35) is eccentrically disposed on the transmission wheel (36) to drive the piston rod (34) to move up-and-down. However, the air compressor (3) is not directly interrelated with the hydraulic jack (not shown), i.e. the air compressor and the hydraulic jack are separate devices.

Figure 1:
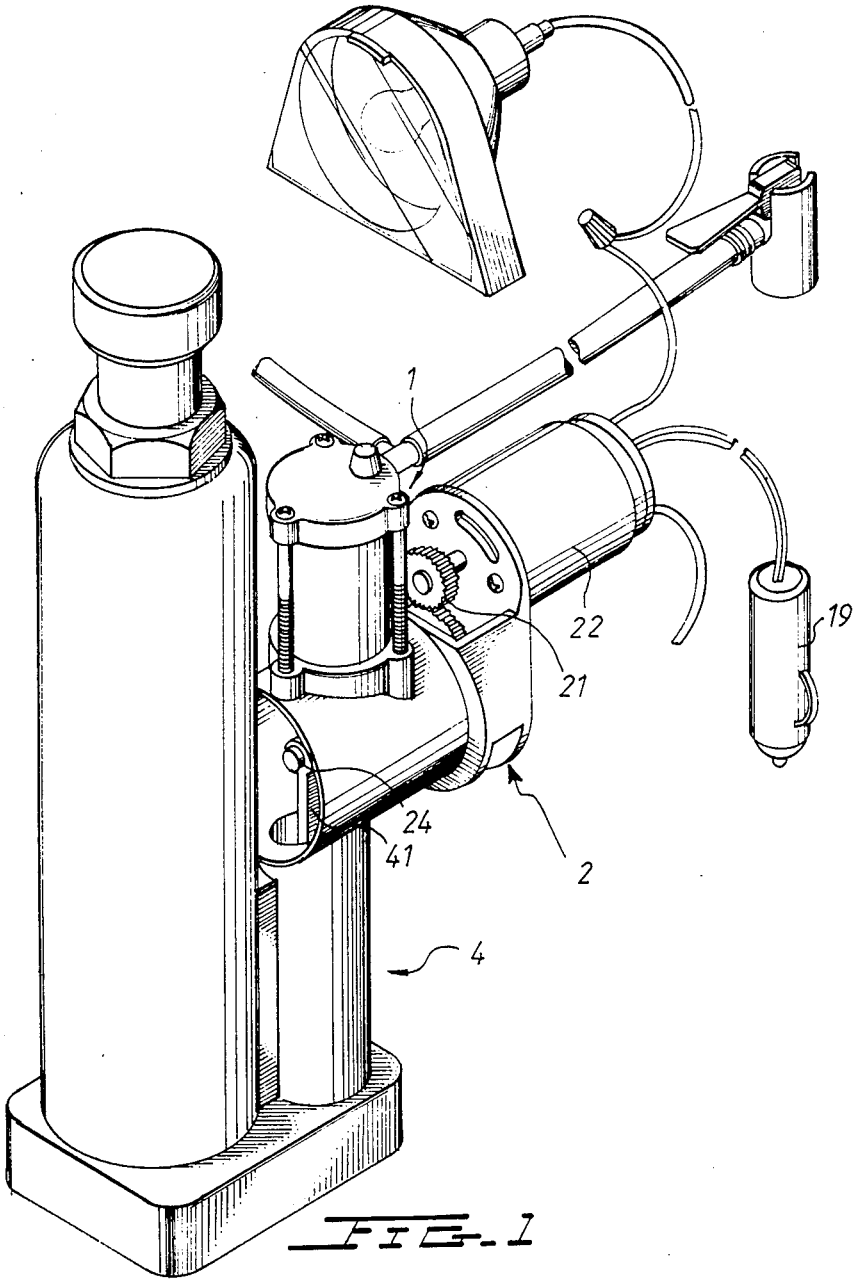
FIG. 1 is a perspective view of the present invention.
Figure 2:
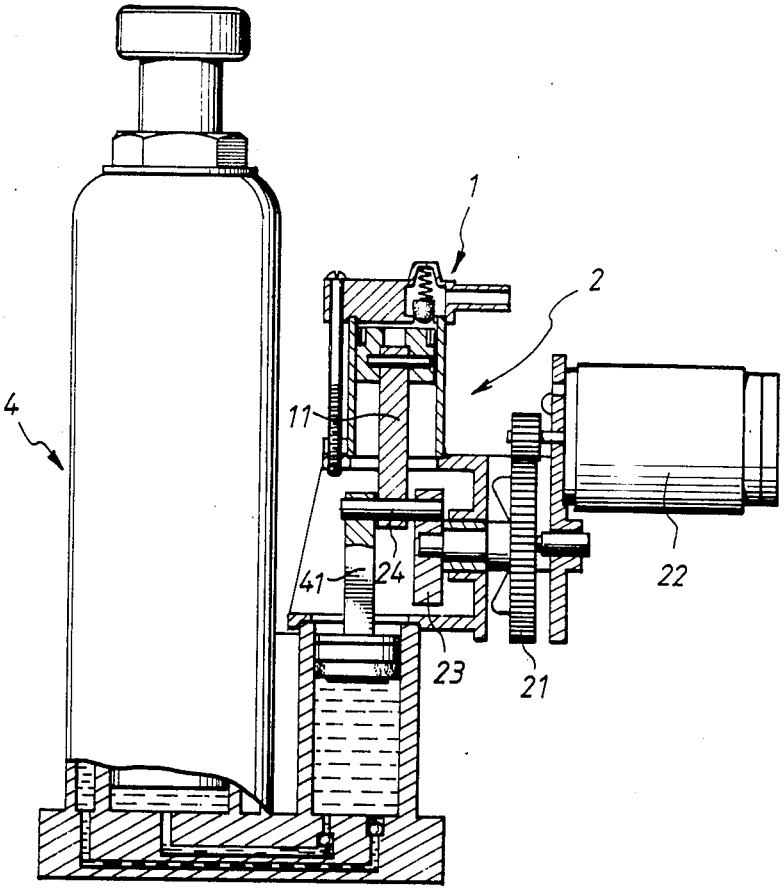
FIG. 2 is a partial cross-sectional view of the present invention showing the transmission mechanism connected to motor and piston rods of air compressor and hydraulic jack.

Referring to FIGS. 1, and 2, it can be seen that the transmission mechanism (2) of the present invention is similar to the transmission (31) of conventional air compressor (3), that is, the transmission mechanism (2) comprises reduction gears (21) connected to and rotated by a motor (22), a transmission wheel (23) connected to reduction gears (21) and a transmission pin (24) eccentrically disposed on the transmission wheel (23). However, the length of transmission pin (24) of the present invention is longer than that of transmission link (35) of conventional air compressors (3). The transmission pin is connected with piston rods (11) and (41) of air compressor (1) and hydraulic jack (4). The air compressor piston rod (11) and the piston connected thereto are disposed above the transmission pin (24) and the hydraulic jack piston rod (41) and piston connected thereto are disposed below the transmission pin (24), so that the transmission pin (24) of transmission mechanism (2) drives the compressor (1) and jack (4) simultaneously. Of course, in principle the present invention would work equally well if, instead of a hydraulic jack (4), a pneumatic jack were used. In that case, the compressor and jack would be combined together and would still provide the two main functions (jacking up the car and inflating the tire after it's repaired) necessary to repair a flat tire.

As various possible embodiments might be made of above-described invention without departing from the scope of the invention, it is to be understood that all matter herein described or shown in the accompanying drawings is to be interpreted as illustrative and not in a limiting sense. Thus it will be understood that the drawings are exemplary of a preferred embodiment of the invention.

I claim:

1. An automobile compressor-jack device comprising a motor, a transmission mechanism, a piston-driven compressor, and a piston-driven jack;

said transmission mechanism comprising a reduction gear which is coupled to and rotated by said motor, said reduction gear coupled to and driving a transmission wheel, said transmission wheel driving an elongated pin eccentrically mounted thereon;

said eccentrically mounted pin coupled to and simultaneously driving both a piston rod of said compressor and a piston rod of said jack upon rotation of said reduction gear.

2. The device of claim 1, wherein said jack is a pneumatic jack.

3. The device of claim 1, wherein the jack is an hydraulic jack.

4. The device of claim 1, wherein the compressor is an air compressor.

5. The device of claim 1, wherein said piston rods extend from said pin in opposite directions from one another.

6. The device of claim 5, wherein said compressor piston rod extends below said pin and said jack piston rod extends above said pin.

7. The device of claim 1, wherein said compressor piston rod is coupled to said pin between said jack piston rod and said transmission wheel.

* * * * *